United States Patent [19]

Houser

[11] 4,325,355

[45] Apr. 20, 1982

[54] HEATING SYSTEM

[75] Inventor: Clifford F. Houser, Flint, Mich.

[73] Assignee: Molecular Energy Corp., Flint, Mich.

[21] Appl. No.: 116,142

[22] Filed: Jan. 28, 1980

[51] Int. Cl.[3] ..... F24J 1/00

[52] U.S. Cl. ..... 126/263; 122/21; 237/1 R

[58] Field of Search ..... 126/263; 122/21; 237/1 R; 422/100, 110

[56] References Cited

U.S. PATENT DOCUMENTS

| | | | |
|---|---|---|---|
| 1,497,970 | 6/1924 | Berkey | 126/263 |
| 3,874,504 | 4/1975 | Verakas | 126/263 |
| 3,975,913 | 8/1976 | Erickson | 122/21 |

*Primary Examiner*—William E. Wayner
*Assistant Examiner*—Henry Bennett
*Attorney, Agent, or Firm*—Fisher, Gerhardt, Crampton & Groh

[57] ABSTRACT

A heating system in which a flameless chemical reaction occurs between a solid metal and a solution which includes means for adding or subtracting the solid metal and separate means for adding the solution. The reaction is under the control of mechanism regulating the immersion of the metal in the solution. The heating system is small and compact with a heat transfer system compatible with available heating systems. Human contact with the chemicals is unnecessary for operating the heating system.

16 Claims, 1 Drawing Figure

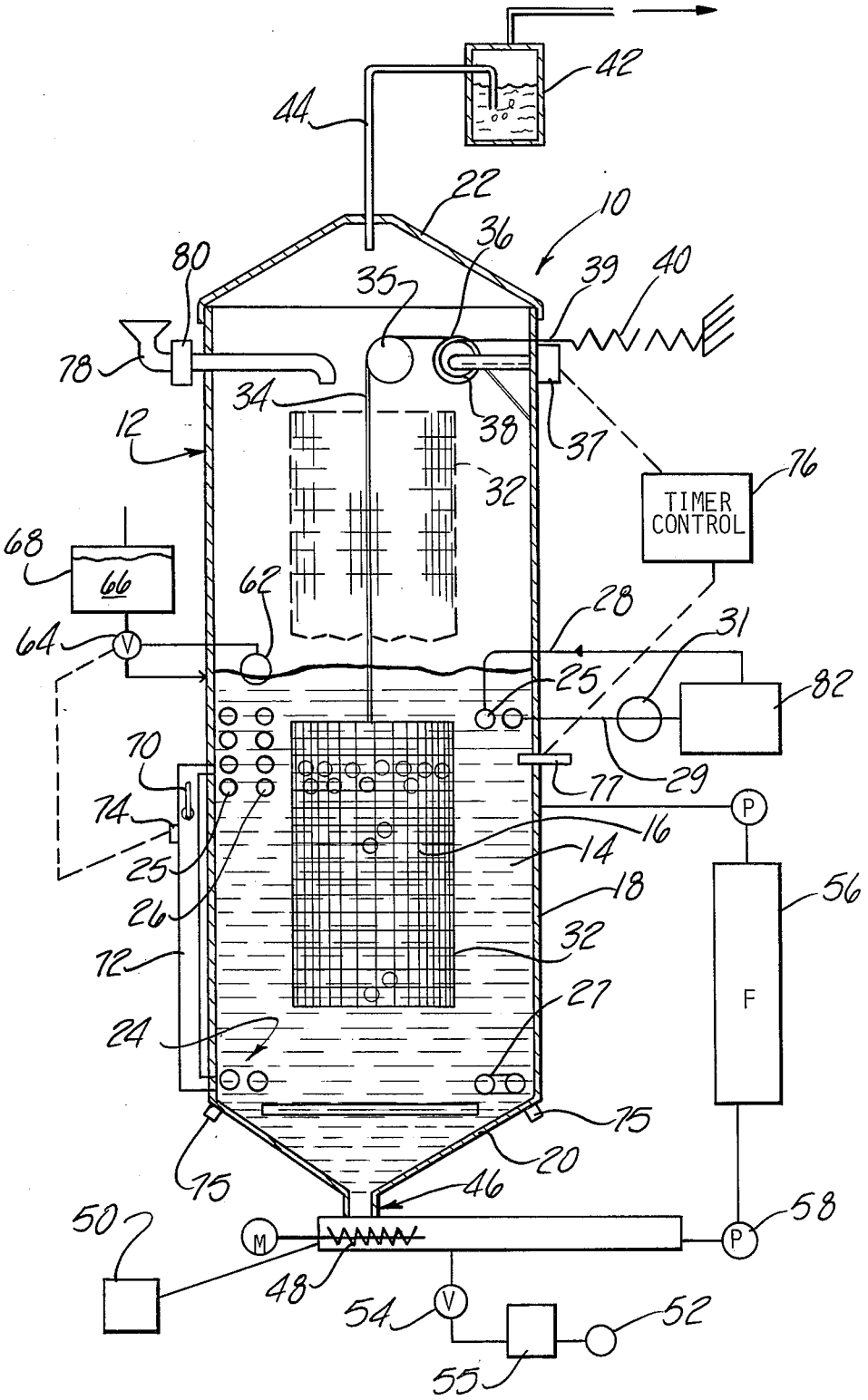
TIMER CONTROL
F
M
P
V

HEATING SYSTEM

This invention relates to heating systems and more particularly to apparatus wherein chemical oxidation reduction reactions proceed in a flameless manner to produce heat.

Most heating systems produce flame when generating heat. Some flameless systems have been developed but they suffer the drawback of utilizing the high internal temperatures needed to melt metal reactants, and therefore, are not really practical for general use. Low temperature, flameless heating systems have been developed for specialized purposes such as providing heat to underwater divers or providing low temperature heat for short durations for cooking food but are impractical for heating large spaces.

It is highly desirable and it is an object of this invention to provide a flameless heating system which does not create atmospheric pollution.

Another object of this invention is to provide a heating system which can consume readily available fuels.

Still another object of this invention is to provide a compact, high energy output heat source.

A further object is to provide a heating system that can operate automatically without constant human intervention, whose convenience of operation will make it acceptable to the average honeowner.

The objects of this invention are accomplished by a flameless heating system having a reservoir of liquid and a container within the reservoir. The container's position is regulated within the reservoir to control its immersion. A solid reactant within the container can react with the liquid to produce heat. A heat transfer means associated with the reservoir removes the heat from the reservoir for distribution.

As an example, a readily available solid reactant is aluminum and a readily available liquid is a sodium hydroxide solution.

The single FIGURE is a diagrammatic view showing of a heating system embodying the invention.

Referring to the drawing, a heating system embodying the invention is designated generally at 10 and includes a housing 12 the lower portion of which forms a reservoir for holding a concentrated solution 14 of a reactant liquid such as alkali metal hydroxide, e.g. solution aqueous sodium hydroxide solution. The solution 14 reacts with a solid metal material such as aluminum 16 which is immersed in the solution to produce heat and release hydrogen to the upper portion of the housing 12.

The housing 12 has a cylindrical wall 18 disposed vertically with a conical lower wall 20 and a removable upper conical cover member 22. Disposed within the housing 12 is a heat exchanger 24 which is made up of two helical coils 25 and 26 of tubing arranged concentrically with the vertical axis of the cylindrical housing 12 and connected together at 27 to form a single continuous flow path. The heat exchanger 24 has an inlet 28 connected at the upper end of the inner helix 25 and an outlet end 29 connected to the upper end of the outer helix 26. The coils 25 and 26 are completely immersed in the solution 14 and water, or other heat transfer liquid is circulated through the coils 25 and 26 by a pump 31.

A container 32, preferably in the form of a stainless steel basket, may be lowered along the vertical axis of the housing until it is completely surrounded by, but not touching, the heat exchanger 24. The container 32 is adapted to hold the aluminum members 16 and is supported within the housing 12 for vertical movement into and out of the solution 14. The means by which the container 32 is supported includes a flexible member 34 such as a chain or cable attached at one end to the container 32 and extending upwards along the central vertical axis of the housing, through a pulley 35 mounted in a fixed position at the upper end of the housing 12 and onto a drum 36. The drum 36 is driven by a reversible direct current motor 37 mounted on the exterior of the housing 12. Actuation of the motor 37 serves to wind and unwind the flexible member 34 on or from the drum 36 which, respectively, raises and lowers the container 32 relative to the solution 14 between the positions depicted in full or broken lines in the drawing. Rotation of the drum 36 also results in rotation of a second drum 38 which winds or unwinds a cable 39 having an end connected to a spring device 40. Lowering of the basket 32 serves to extend the spring device 40 so that it assists the motor during raising of the basket. In the event of motor or power failure, the spring automatically lifts the basket from the solution.

When the container 32 is lowered into the solution 14 the resultant chemical reaction produces heat which heats the solution 14. Heat from the solution is transferred to the coils of the heat exchanger 24 and to the heat transfer liquid which is circulating therein.

Where the solution is sodium hydroxide and the metal is aluminum, the chemical reaction results in the release of hydrogen which rises to the apex of the conical cover 22 and communicates with a water bath 42 via a conduit 44. From the water bath 42, the hydrogen may be transferred to storage or disposed of by burning. The water bath 42 isolates the interior of the housing 12 thereby preventing ignition of the hydrogen within the heating system in the event of localized ignition of the hydrogen.

Sodium aluminate, produced by the reaction between the sodium hydroxide solution 14 and aluminum 16 forms a sludge. The lower wall 20 of the housing 12 is sloped so that the sludge is directed to a drain system 46. The drain system 46 can be provided with an ejector 48 such as a worm conveyor for the purpose of ejecting or transporting the sediment or sludge from the housing. The ejector 48 can convey the solid waste to a receiver 50. Alternatively, the sludge may be allowed to drain into the sewer system 52 by opening valve 54 and permitting drainage through filter 55.

A filter 56 is connected in series with the drainage system 46 and is connected to receive the solution 14 which is moved by means of a pump 58 upwardly through the filter 56 and through a conduit 60 for return to the interior of the housing 12. The pump 58 serves to circulate the solution through the filter 56 and the housing on a continuous basis to trap particles in the solution and to move the solution relative to the heat exchanger 24 to enhance the heat exchange function.

The level of the solution 14 in the housing 12 is regulated by a float 62 which signals an electrically operated valve 64 to control the supply of make-up solution 66 from a tank 68. Also, the specific gravity of the solution is maintained at a predetermined value by means of a hydrometer 70. Preferably, the hydrometer 70 is a type which can remain submerged in a fixed position. In the present instance, the hydrometer 70 is supported within a vertical tube 72 having its upper and lower ends connected to the walls of the housing 12 so that the solution within the tube 72 communicates with the solution 14 in the housing 12. The change in position of the hydrometer 70 triggers a sensing device 74 such as photocell or proximity switch which actuates the valve 64 for delivery of additional solution from the make-up tank 68 to the solution 14 in the housing 12.

To initiate operation of the heating system the lower portion of the housing 12 is filled with a solution 14 and the container 32 is raised above the level of the solution and filled with aluminum members 16. With the removable cover 22 in place, the system is in readiness for operation.

To activate the heating system, an electric wrap around heating element 75 at the bottom of the housing 12 is energized and the container 32 is lowered into the solution 14. After the heating element 75 has raised the temperature of the solution to about 140° fahrenheit for full efficiency it is automatically turned off.

Once the heating system is at its operating temperature, the temperature may be automatically regulated by a temperature control 76. One such temperature control 76 is marketed under the name "Aquastat" by Minneapolis Honeywell Company and permits the selection of a temperature range by manual setting of the upper and lower limits. The temperature control 76 senses the temperature of the solution from a thermocouple 77 and acts to control the operation of the reversible motor 40. As an example, with the upper limit of the temperature control 76 set at 180° fahrenheit and the container 32 immersed in the solution, the chemical reaction taking place will tend to increase the heat of the solution. As the temperature of the solution 14 approaches 180° fahrenheit, the temperature control 76 energizes the motor 40 to wind the flexible member onto the drum 38 to raise the container 32 from the solution thereby terminating both the chemical reaction and the temperature increase caused therefrom. As the temperature of the solution 14 drops to some other preselected temperature, such as 160° fahrenheit, the temperature control 76 will cause the motor 40 to reverse thereby unwinding the flexible nember 34 from the drum 38 and lowering the container 32 into the solution 14 to resume the chemical reaction. In this manner, the solution temperature will be automatically kept within the predetermined upper and lower limits set on the temperature control 76.

When more aluminum 16 is needed in the container 32 it may be introduced via an injector 78. The injector 78 may be arranged to receive balls of aluminum 16 with uniform diameters to permit the aluminum to pass through a one way valve arrangement indicated generally at 80. This allows the aluminum to enter the heating system for deposit in the container 32 but precludes the escape of gases from the housing 12.

The concentration of sodium hydroxide solution is automatically kept constant. When the concentration of the solution 14 decreases, the hinged hydrometer 70 passes through a predetermined portion of its 90° arc triggering sensing device 74 which in turn activates a motor 63 opening a valve 64 and allow make-up solution 66 from the make-up tank 68 to pass into the housing 12. When the predetermined concentration of sodium hydroxide is attained, the hydrometer 70 will trigger the device 74 which will signal the motor 63 to reverse and close the valve 64 to the make-up tank 68, thereby terminating the flow of make-up solution 66 from the make-up tank 68 to the interior of the housing 12.

The solution lever in the housing 12 also is maintained automatically. A float 62, which rises and falls with the solution level, activates a motor 63 which opens a valve 64 which allows the make-up solution 66 to flow from the make-up tank 68 into the housing 12, when the solution level drops. When the desired solution level is restored, the float 62 causes the valve 64 to close and terminate the flow of solution from the make-up tank 68 into the housing 12.

During the chemical reaction which maintains the heat of the solution 14 in some preselected range, heat exchange fluid is conveyed through the exchanger 24 by the pump 31 which serves also to circulate the heated fluid being delivered through outlet 29 through a heating service system indicated at 82 and back through inlet 28 to the heat exchanger 24. The heating service system 82 can be a hot water heating system such as used in residential heating, or can incorporate another coiled heat exchanger which heats air of a conventional forced air heating system.

A heating system has been provided for producing heat without flame by employing a chemical reaction within a closed housing so the heat of the reaction between a solid metal such as aluminum and a liquid solution such as aqueous sodium hydroxide increases the temperature of the solution which is transferred by way of a heat exchanger in the form of a coiled tube conveying water or the like. The water is heated in the coils and conveyed to the exterior of the housing where the heat can be used in a second heat exchange arrangement such as a hot water residential heating system, or other heat exchanger by which the heat can be utilized. The heating process is continuous and the temperature of the solution is regulated by controlling the immersion of the metal in the solution by moving a container holding the metal between the position in which the metal is completely immersed and a position in which the metal is completely removed from the solution, all in response to the temperature of the solution. Means also are provided to continuously regulate and maintain the specific gravity of the solution and the level of the solution in the container at a predetermined selected value. The solution also is continuously circulated through a filter to remove solids from the solution and to move the solution relative to the heat exchanger coils.

The embodiments of the invention in which an exclusive property or privilege is claimed are defined as follows:

1. A heating system for continuously producing heat by flameless exothermic reaction comprising; an enclosed housing, a liquid solution occupying the lower portion of said housing, a container movably disposed in said housing and being supported for movement completely into and out of said solution, a solid metal material disposed in said container and being capable of reacting with said solution, a movement means regulating the immersion of said container downwardly into said solution in response to the temperature of said solution below a predetermined valve and upwardly from said solution in response to the temperature of said solution above another predetermined valve, and heat transfer means completely immersed in said solution for absorbing heat from said solution and conveying it to the exterior of said housing.

2. The heating system of claim 1 wherein said solid metal matter is aluminum, and said solution includes sodium hydroxide.

3. The heating system of claim 1 wherein said housing has a vent for discharging gas produced by said exothermic reaction.

4. The heating system of claim 1 wherein said vent discharges gas through a water bath to prevent flashback.

5. The heating system of claim 1 wherein said housing has a drain for discharging solid waste produced by said exothermic reaction.

6. The heating system of claim 2 wherein said metal is in the form of balls.

7. The heating system of claim 6 wherein the balls are of uniform size.

8. The heating system of claim 1 comprising a tubular conveyor for receiving the aluminum balls at the exterior of said housing and conveying them into the housing and into said container.

9. The heating system of claim 1 and further comprising means continuously circulating said solution.

10. The heating system of claim 9 wherein said means circulating said solution includes a filter apparatus for removing solid particles from said solution.

11. The heating system of claim 1 wherein said container is supported by a flexible member wound on a drum, and means connected to said drum to wind and unwind said flexible member.

12. The heating system of claim 11 wherein said means connected to said drum is a reversible motor, and temperature control means responsive to the temperature of said solution controls said motor and the direction of rotation of said drum.

13. The heating system of claim 1 comprising a heating element for initially and rapidly raising the temperature of said solution to its operating temperature.

14. A heating system for producing heat by flameless exothermic reaction comprising; a generally cylindrical housing disposed circumferencially about a vertical axis, a liquid solution of sodium hydroxide disposed in the lower portion of said housing, a means to maintain said solution at a substantially predetermined level, a heat exchanger in the form of a helical coil disposed in said solution and conveying liquid from the exterior of said housing through said solution and to the exterior of said housing, a container supported for movement between a first position above said predetermined level of said solution, and a second position within said helical coil and below said predetermined level of said solution, solid aluminum particles disposed in said container for chemical reaction with the liquid solution of sodium hydroxide when the container is in the second position, a motor means to move said container between said first and second positions, and a temperature control means sensing the temperature of said solution and being connected to actuate said motor means and move said container automatically into and out of the solution in response to the temperature of the solution.

15. The heating system of claim 14 containing a float actuating means for keeping a constant solution level within the housing.

16. The heating system of claim 14 including a hydrometer actuated means for maintaining a constant sodium hydroxide solution concentration.

* * * * *